US010654055B1

(12) United States Patent
Alonso et al.

(10) Patent No.: US 10,654,055 B1
(45) Date of Patent: May 19, 2020

(54) AEROSOL SPRAY GUN

(71) Applicants: Leonardo Alonso, Miami, FL (US); Nelson Alonso, Miami, FL (US)

(72) Inventors: Leonardo Alonso, Miami, FL (US); Nelson Alonso, Miami, FL (US)

( * ) Notice: Subject to any disclaimer, the term of this patent is extended or adjusted under 35 U.S.C. 154(b) by 0 days.

(21) Appl. No.: 16/706,477

(22) Filed: Dec. 6, 2019

(51) Int. Cl.

| | |
|---|---|
| ***B05B 7/08*** | (2006.01) |
| ***B05B 7/06*** | (2006.01) |
| ***B65D 83/20*** | (2006.01) |
| ***B05B 7/24*** | (2006.01) |
| ***B05B 7/00*** | (2006.01) |
| ***B05B 12/00*** | (2018.01) |

(52) U.S. Cl.
CPC ..... *B05B 7/0815* (2013.01); *B05B 7/066* (2013.01); *B65D 83/202* (2013.01); *B05B 7/0081* (2013.01); *B05B 7/2416* (2013.01); *B05B 12/002* (2013.01)

(58) Field of Classification Search
CPC ..... B05B 7/0081; B05B 7/066; B05B 7/0815; B05B 7/0823; B05B 7/083; B05B 7/2416; B05B 12/0022; B05B 12/002; B65D 83/20; B65D 83/201; B65D 83/202; B65D 83/203; B65D 83/205; B65D 83/206; B65D 83/207
See application file for complete search history.

(56) References Cited

U.S. PATENT DOCUMENTS

| | | | | |
|---|---|---|---|---|
| 7,743,950 | B2 * | 6/2010 | Tsai | B65D 83/202 222/323 |
| 7,753,237 | B2 * | 7/2010 | Tsai | B65D 83/202 222/323 |
| 8,052,015 | B2 * | 11/2011 | Huang | B65D 83/202 222/153.09 |
| 8,272,542 | B2 * | 9/2012 | Becker | B65D 83/202 222/402.13 |
| 8,714,416 | B2 * | 5/2014 | Becker | B65D 83/202 222/402.13 |
| 9,533,818 | B2 * | 1/2017 | Wang | B65D 83/202 |
| 10,329,078 | B1 * | 6/2019 | Alonso | B05B 7/083 |
| 10,351,335 | B1 * | 7/2019 | Alonso | B65D 83/20 |
| 2016/0279652 | A1 * | 9/2016 | States, III | B65D 83/24 |

* cited by examiner

*Primary Examiner* — Darren W Gorman
(74) *Attorney, Agent, or Firm* — Christopher J. Van Dam, PA; Chris Vandam

(57) ABSTRACT

An aerosol spray gun that holds an aerosol can to aid in dispensing it's contents. A main arm inside the body has a trigger on a rear side of a main pivot and on a forward side has tab and a forward pivot. A nozzle assembly with an open center is at a forward side of the body. The aerosol spray and fan-forced air pass through the open center during dispensing. When the trigger is pulled the main arm articulates about the main pivot causing the forward side of the main arm to move down simultaneously pressing the valve on the aerosol can down and moving the nozzle assembly down so that the aerosol spray and the open center of the nozzle assembly always remain concentric.

5 Claims, 6 Drawing Sheets

AEROSOL SPRAY GUN

CROSS-REFERENCES TO RELATED APPLICATIONS

None.

STATEMENT REGARDING FEDERAL SPONSORED RESEARCH OR DEVELOPMENT

None.

NAMES OF PARTIES TO A JOINT RESEARCH AGREEMENT

None.

REFERENCE TO A "SEQUENCE LISTING", A TABLE, OR A COMPUTER PROGRAM LISTING APPENDIX SUBMITTED ON COMPACT DISC AND INCORPORATION-BY-REFERENCE OF THE MATERIAL ON THE COMPACT DISCLOSURE

None.

STATEMENT REGARDING PRIOR DISCLOSURES BY AN INVENTOR OR JOINT INVENTOR

None.

BACKGROUND OF THE INVENTION

1. Field of the Invention

The present invention relates to aerosol can spray handles, and more particularly, to an improved device and method of use to apply an aerosolized liquid from a can with an improved, controllable spray pattern and forced air.

2. Description of Related Art Including Information Disclosed Under 37 CFR 1.97 and 37 CFR 1.98

Several designs for spray can handles have been designed in the past. None of them, however, includes a way to automatically center the supplemental forced air concentric with the orifice expelling fluid from an aerosol can.

Applicant believes that the closest reference corresponds to U.S. Pat. No. 10,351,335 issued to common inventors Leonardo and Nelson Alonso. However, it differs from the present invention because the present invention links the arm that depresses the cap of the aerosol can to the nozzle assembly to hold concentric the axis of the supplemental shaping air with the axis of the can's orifice. This results in a consistent spray pattern throughout the range of rate of aerosol spray.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

BRIEF SUMMARY OF THE INVENTION

It is one of the main objects of the present invention to provide a spray can handle that holds a spray can indexed in a forward spray direction that simultaneously and automatically keeps the nozzle assembly concentric with the axis of spray from the can's orifice.

It is another object of this invention to provide a spray can handle that consistently delivers the aerosolized liquid with the same pattern throughout the range of spray volume.

It is still another object of the present invention to provide a spray can handle that adjusts the spray shaping supplemental air nozzles to any orientation.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWING

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
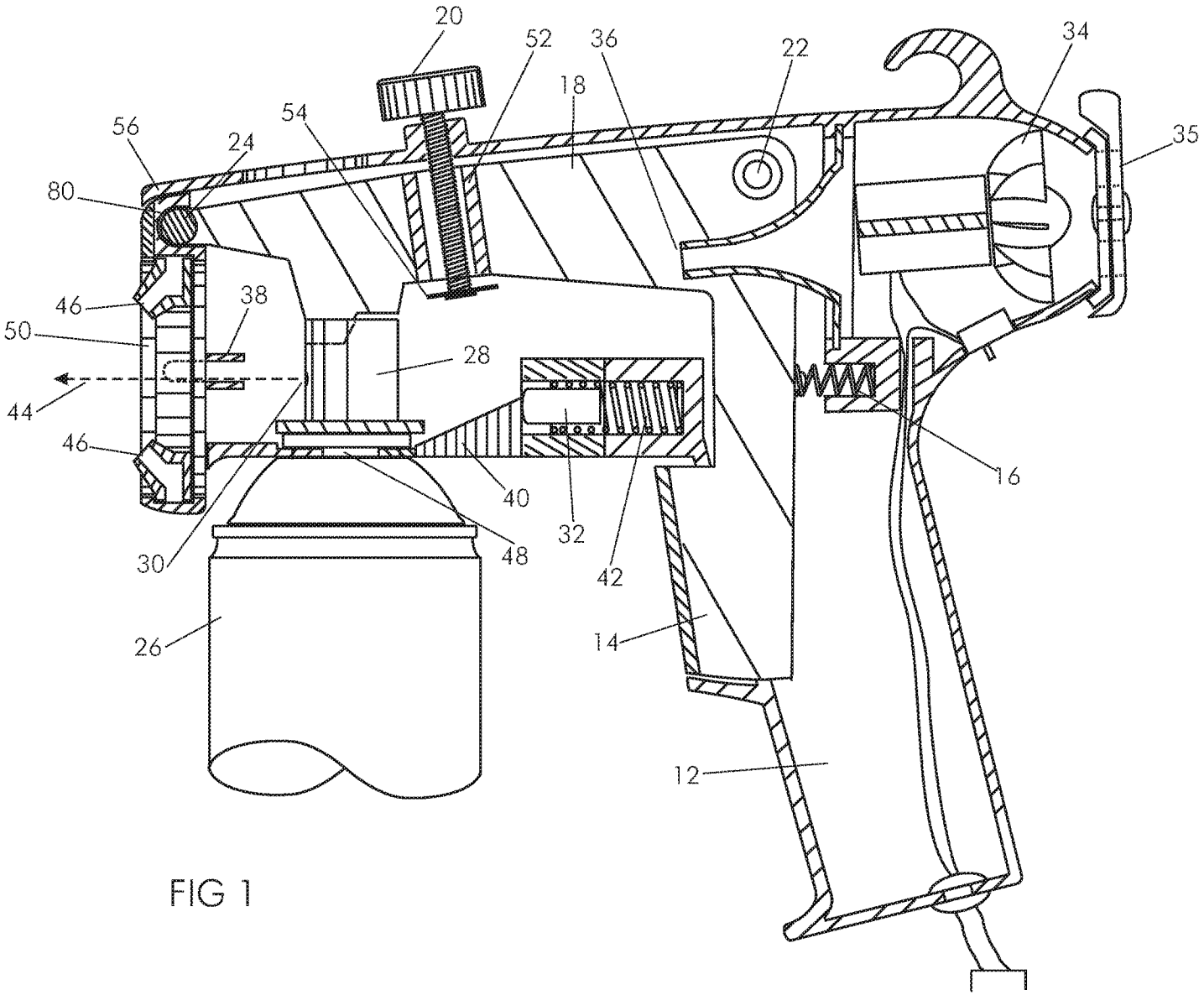
FIG. 1 shows an elevation cross section view of a spray can handle.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the spray can handle, the spray gun, the handle, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a handle 12, a trigger 14, a spring 16, an arm 18, a control 20, a pivot 22, a pivot 24, a can 26, a cap 28, an orifice 30, a lever 32, a fan 34, A louver 35, a connector 36, a connector 38, a wedge 40, a spring 42, an axis 44, a nozzle 46, a neck 48, a nozzle assembly 50, a tube 52, a stop 54, a body 56, a conduit 58, a switch 60, a cord 62, a gap 64, a face 66, a tab 68, a notch 70, a track 72, a tab 74, a ring 76, a track 78, a notch 80, a vent 82, a groove 84 and an aperture 86.

The spray can handle has a handle 12 that is dimensioned to fit a typical human hand, similar to a pistol grip. The user's fingers can wrap around the handle 12 and squeeze the integrated trigger 14 to operate the spray can handle to dispense a liquid held inside the can 26.

The spray can handle is adapted to hold and dispense a liquid, such as paint, adhesive or lubricant, contained in an aerosol can 26. The can 26 is pressurized with the liquid contents. A cap 28 is provided that when pressed the contents of the can 26 are dispensed through an orifice 30. The neck 48 of the can 26 is held inside the front of the device by a wedge 40 that is spring 42 loaded to pinch the neck 48.

To insert and remove the can 26 the user pulls back the lever 32 to compress the spring 42 and withdraw the wedge 40 towards the rear of the device. The neck 48 of the can 26 is then inserted and the lever 32 is released causing the wedge 40 to be forced forward under power of the spring 42 causing the wedge 40 to pinch the neck 48 with sufficient force to hold the can 26 securely into the spray can handle.

The cap 28 of the can 26 has a notch 70 to index the position of the orifice 30 and ensure that the orifice 30 is facing forward, centered through the aperture 86. The tab 68 on the forward part of the arm 18 fits into the notch 70 to affirmatively orient the orifice 30. The tab 68 also prevents the cap 28 and orifice 30 from rotating during use of the device while the can 26 is inserted into the bottom front of the device.

The arm 18 is integrally formed with the trigger 14. When the trigger 14 is pulled the arm 18 articulates about the pivot 22 forcing the tab 68 to press the cap 28 to dispense the liquid in the can 26. Simultaneously, as the arm 18 presses the cap 28 down the forward side of the arm 18 presses against the nozzle assembly 50 moving it downward to match the position of the orifice 30 that is moving downward in lockstep.

A control 20 is provided that is connected to the top of the body 56. The control 20 is threaded through the body 56 to move the stop 54 up and down. This serves to effectively limit the range that the arm 18 can be move down onto the cap 28. If the control 20 is threaded up the stop 54 is raised and the arm 18 will not be able to travel as far down. When the control 20 is threaded down the stop 54 is lowered and the arm 18 is able to be moved lower to press the cap 28 more and thereby dispense the fluid in the can 26 at a faster rate.

Tube 52 is provided integral to the arm 18. This allows the threaded control 20 rod to not interfere with the movement of the arm 18 until the washer on the bottom of the control 20 contacts the bottom side of the tube 52. The control 20 threads up and down relative to the body 56 taking with it the stop 54. When the stop 54 is threaded up into a high position the arm 18 will not be able to move down as far as when the stop 54 is threaded down. The farther the arm 18 and connected tab 68 are able to move down the more the cap 28 is depressed and the greater the volume of liquid sprayed from the can 26.

The switch 60 turns the fan 34 on and off. The fan 34 causes ambient air to be pushed forward through the body 56 and be expelled through the nozzle assembly 50. Air is drawn into spray can handle through a louver 35 in the rear of the device and is pushed through the connector 36, then through the conduit 58 to the connectors 38 in the nozzle assembly 50. There may be a left and a right conduit 58 where each of the conduits 58 are individually connected to the connector 36 at the rear of the device and then each of the conduits run in parallel to the left and right connectors 38 on the rear side of the nozzle assembly 50.

Figure 8:
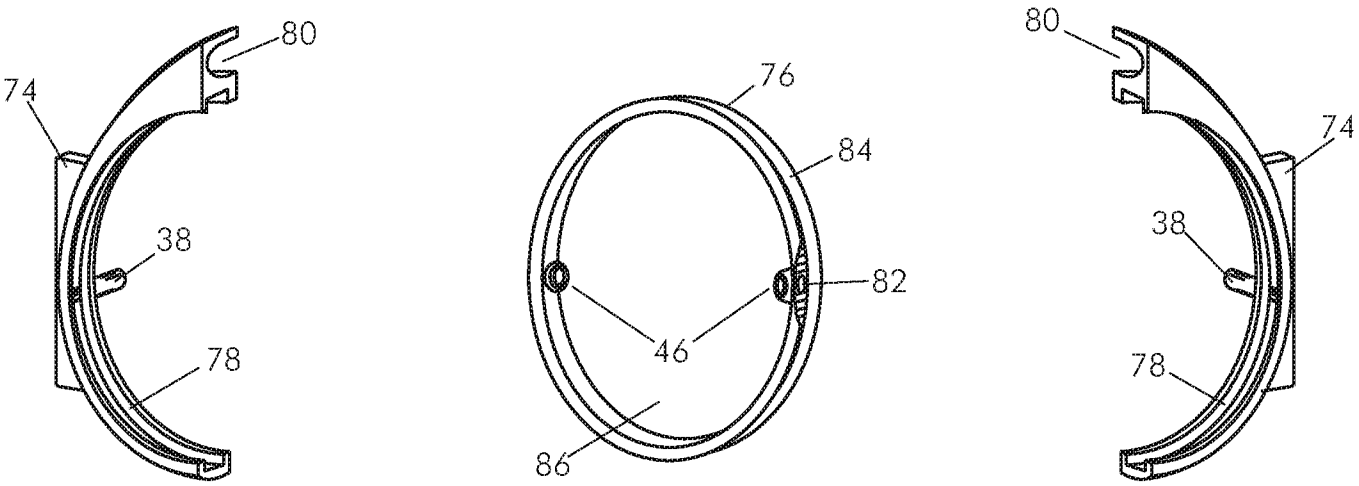
FIG. 8 shows an exploded perspective view of a nozzle assembly.
Figure 10:
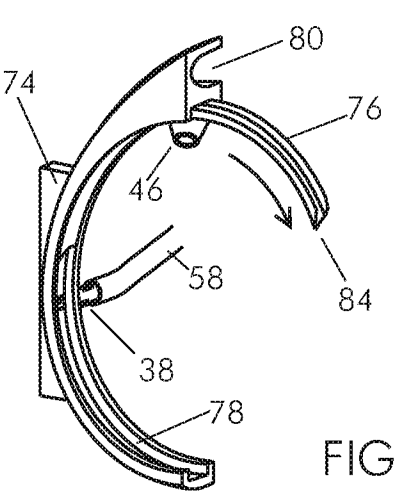
FIG. 10 shows a truncated perspective view of a nozzle assembly.
Figure 9:
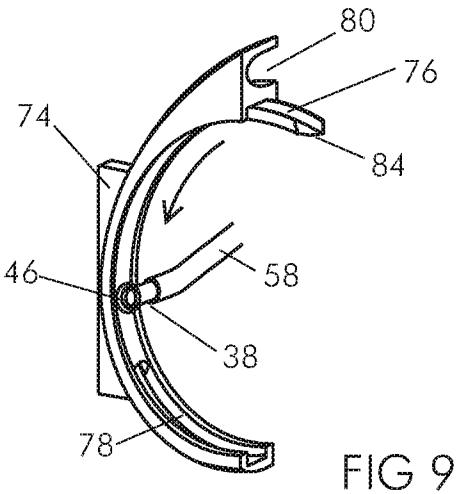
FIG. 9 shows a truncated perspective view of a nozzle assembly.

Looking at FIGS. 8-10 it can be seen that the nozzle assembly 50 is comprised of two concentric elements: the ring 76 that rides in the track 78. The ring 76 as two nozzles 46, one each on opposite sides of the ring 76. These nozzles 46 are where the air from the fan 34 exits the front of the device to push the liquid being dispensed from the can 26.

The nozzles 46 may be angled inwards toward the axis 44 to shape the aerosolized liquid being applied with the spray can handle. This creates a fanned spray pattern to help the person applying the liquid do so in a more controlled manner. For example, a painter is able to more evenly apply paint with a horizontal stroke when the fan pattern is vertical. The nozzles 46 will tend to make a vertical fan pattern when they are horizontal, essentially at the 3 and 9 o'clock positions.

The air flowing out of the nozzles 46 also pushes or carries along the liquid being sprayed. This can help a user of the device get the liquid being applied to better adhere to the substrate and to get into every nook and cranny of the substrate. For example, coating a detailed carved surface or the inside of a housing can be improved with the additional force of air pushing the sprayed liquid.

The ring 76 includes a groove 84 about the circumference. The groove 84 is bounded on an outer side with the track 78. The combination of the groove 84 and track 78 create a channel for the air to flow from the connections 38 to their respective nozzles 46. The nature of this channel does not change regardless of the orientation of the nozzles 46. The nozzles 46 on the ring 76 can be rotated to any position and the groove 84 carries the air around the ring 76.

Inside the groove 84 under each of the nozzles 46 is a vent 82 that allows the air to pass through the groove 84 and out through the nozzles 46 on the inside of the ring 76. The ring 76 is captured inside the track 78 so that the ring 76 with integral nozzles 46 can be at any position. The ring 76 fits snugly into the track 78 so that there is minimal air leakage between the track 78 and ring 76 and provides some friction between these parts so that the ring 76 does not move by itself but stays in the orientation selected by the user of the device.

Room air is drawn into the rear of the spray can handle by the fan 34. The fan 34 pushes the air through the connector 36 and into the conduits 58. The conduit 58 on the forward end is connected and delivers the air to the connectors 38 on the nozzle assembly 50. The air then flows into the track 78 and groove 76 combination and then through the vents 82 and then out of the nozzles 46. The air then passes through the aperture 86 where the air is ultimately mixed with the liquid being dispensed to carry and shape that liquid as it is being sprayed onto the substrate.

The ring 76 is generally permanently surrounded by the track 78 so that they do not separate in normal use of the device. FIG. 8 shows these parts separated for a clearer understanding of the relationship between the ring 76 and track 78. The ring 76 rotates inside the track 78 while the axis 44 remains concentric for both the ring 76 and the track 78.

The track 78 has a tab 74 on each the left and right. The tab 74 is dimensioned to slidably engage into the tracks 72 on the inside forward surface of the body 56 on both the left and right sides. The tab 74 rides only up and down in the track 72 and thereby moves the axis 44 of the ring 76 up and down. The track 72 ensures that the axis 44 is maintained perpendicular to the circumference of the ring 76.

At the forward end of the arm 18 is a pivot 24. The pivot 24 engages into the notch 80 that is formed integral to the nozzle assembly 50. The pivot 24 and notch 80 articulate to a degree necessary to keep the face of the nozzle assembly 50 vertical and perpendicular to the axis 44 that defines the central thrust vector of the fluid being dispensed from the can 26 during use.

The axis 44 of both the nozzle assembly 50 and the orifice 30 are generally maintained coincidental. As the user squeezes the trigger 14 the trigger 14 is forced rearward into the handle 12. The arm 18 is forced downward to press both the cap 28 of the can 26 downward with the tab 68 and also at the same time press the nozzle assembly 50 down when the pivot 24 presses down on the notch 80 that is integral to the nozzle assembly 50. Therefore, as the axis 44 of the orifice 30 is lowered the axis 44 of the nozzle assembly 50 remain coincidental and automatically are perfectly aligned.

Similarly, as the trigger 14 is released the arm 18 also is raised causing the tab 68 and cap 28 to raise and stop or slow the dispensing of the liquid and also the axis 44 of the nozzle assembly 50 is also raised equally and at the same time.

Figure 2:
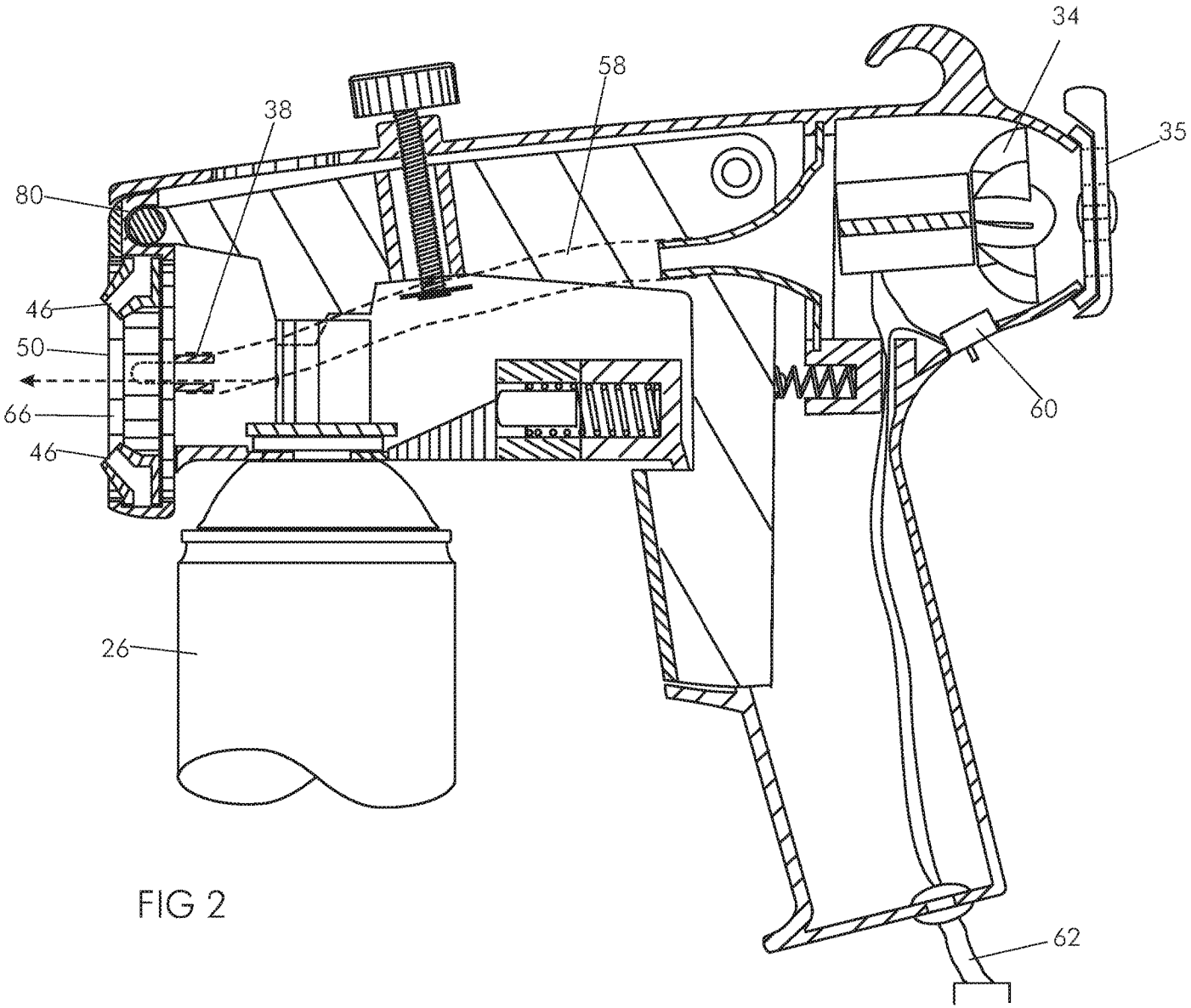
FIG. 2 shows an elevation cross section view of the spray can handle.
Figure 3:
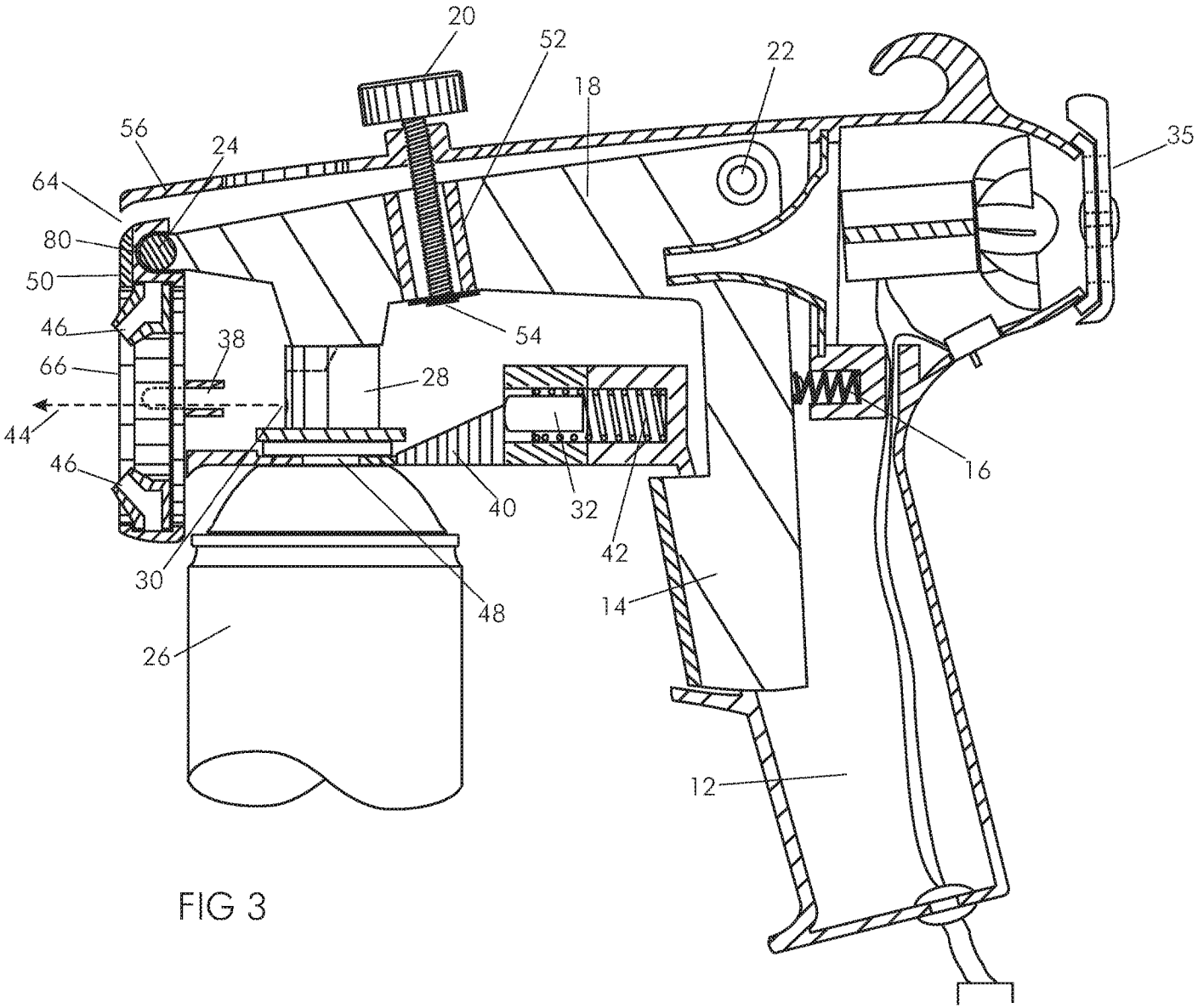
FIG. 3 shows an elevation cross section view of the spray can handle.
Figure 4:
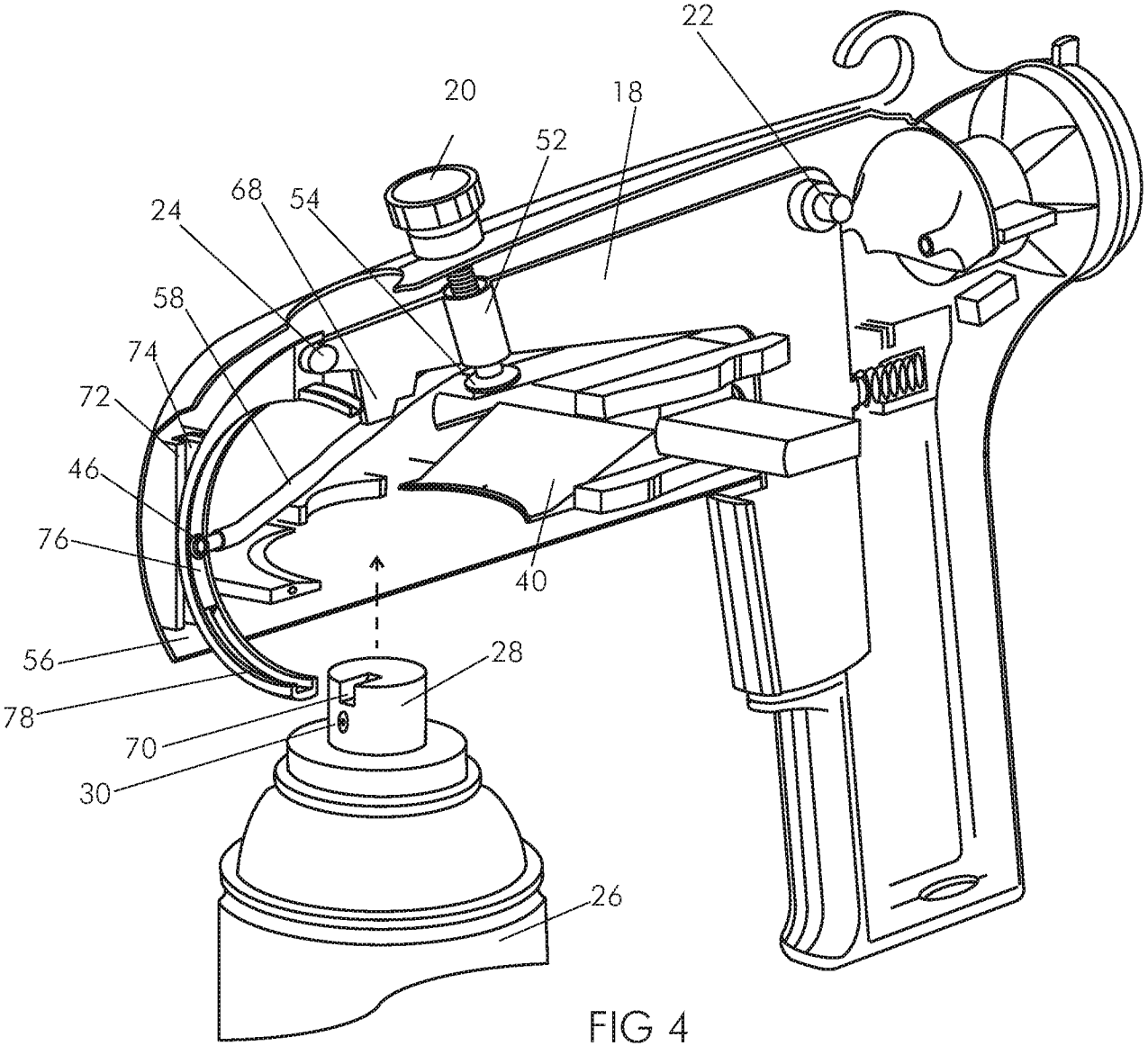
FIG. 4 shows a perspective cross section view of a spray can handle.
Figure 5:
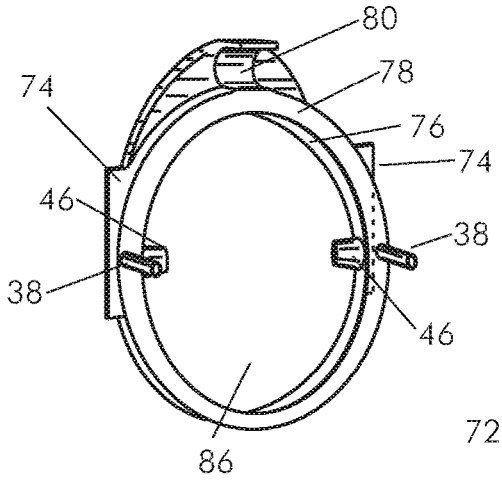
FIG. 5 shows an exploded perspective view with partial transparency of a forward end of a spray can handle.
Figure 5:
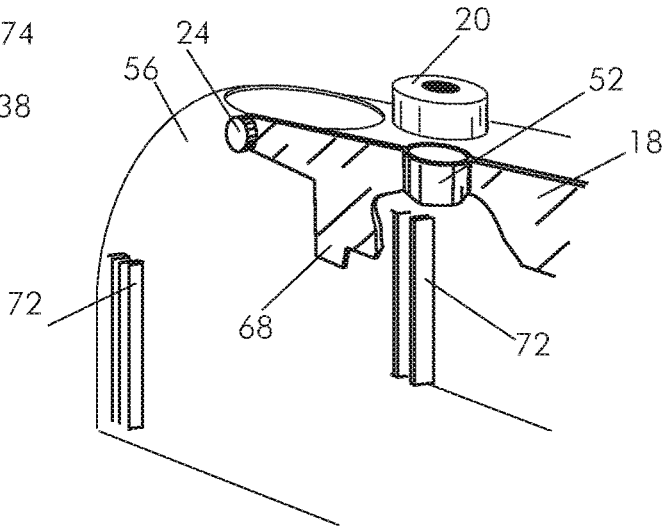
Figure 6:
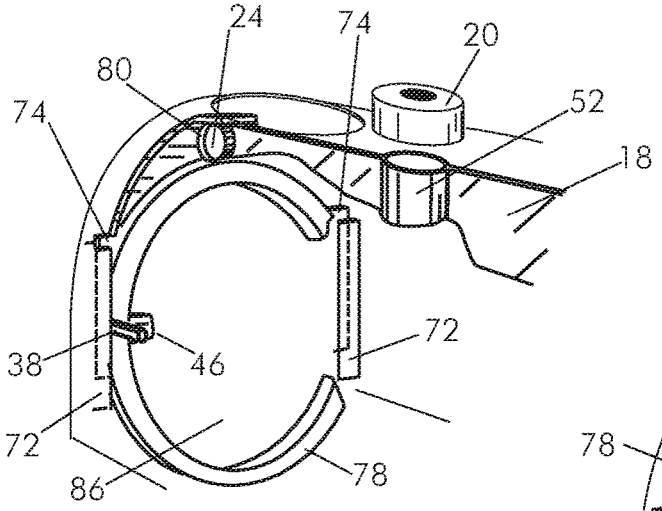
FIG. 6 shows a perspective view with partial cross section of a forward end of a spray can handle.
Figure 7:
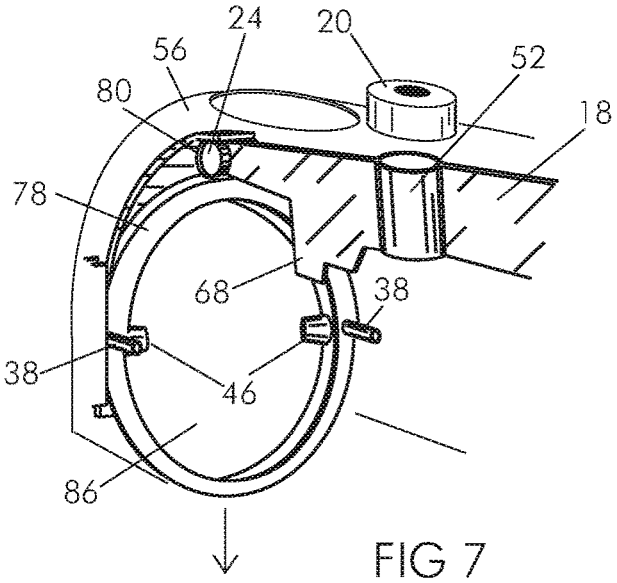
FIG. 7 shows a perspective view with partial cross section of a forward end of a spray can handle.

The concept of keeping the orifice 30 and axis 44 of the nozzle assembly 50 is shown well in FIGS. 2 and 3. In FIG. 2 the trigger 14 is not depressed and is in its forward most position as biased by a spring. The cap 28 of the can 26 is not being depressed and no fluid is being sprayed. Notice in FIG. 2 that the notch 80 is at or nearly in contact with the upper inside of the forward body. This is contrasted to FIG. 3 where the trigger 14 is shown pulled rearward causing the arm 18 to be forced down about the pivot 22. The front end of the arm 18 is simultaneously pushing the tab 68 downward into the cap 28 and pressing the pivot 24 down against the notch 80 forcing the nozzle assembly 50 to slide down the tracks 72. A gap 64 is created when the nozzle assembly 50 is moved down to remain in alignment with the orifice 30.

The control 20 should also be noted in FIGS. 2 and 3. In FIG. 2 the stop 54 of control 20 is not contacting the arm 18 at the bottom of the tube 52 because the arm 18 is in a raised position. Contrasted to FIG. 3 where the arm 18 is in a lowered position, the stop 54 is in contact with the bottom of the tube 52 and thereby limits further downward movement of the arm. FIG. 3 shows the device producing maximum liquid dispensation in this configuration. Only by lowering the control 20 more and thereby lowing the stop 54 can greater volumes of liquid be sprayed out the front of the spray can handle.

An important example of the invention can be fairly described as an aerosol spray gun comprising a body 56 containing, among other things, a fan 34 and an arm 18. A rear segment of the arm 18 comprises a trigger 14. A forward segment of the arm 18 comprises a front pivot 24 positioned forward of a tab 68. The arm 18 articulates about a main pivot 22 positioned between the rear segment of the arm 18 and the forward segment of the arm 18. An aerosol can 26 containing a liquid to be dispensed is attached to the body 56 below the forward segment of the arm 18. The aerosol can 26 has a cap 28 including an integral valve that can be pressed to dispense the contents of the can 26. The cap 28 has an orifice 30 on a forward facing side. The orifice 30 defines a center of a spray axis 44. The fan 34 draws in air and pushes the air through a conduit to a nozzle assembly 50. The nozzle assembly 50 slides vertically in a track 72 at a front end of the body 56. The nozzle assembly 50 has a central aperture 86 through which the spray axis 44 passes. The nozzle assembly 50 includes a pair of nozzles 46, one each on opposing sides of the central aperture 86. The air exits the nozzle assembly 50 through the pair of nozzles 46. The nozzle assembly 50 is connected to the front pivot 24. Wen the trigger 14 is depressed the arm 18 articulates about the main pivot 22 causing the tab 68 to force the cap 28 down to open the integral valve while simultaneously moving down the front pivot 24 to force the nozzle assembly 50 down the same distance as the cap 28 thereby maintaining a center of the aperture 86 concentric with the spray axis 44. Optionally, a control 20 is provided that adjustably limits the extent of downward movement of the arm 18 by threading up and down. Optionally, the nozzles 46 are adjustable from being opposed horizontally to being opposed vertically or at any point in between. Optionally, and adjustable louver 35 is provided at an air intake at the rear of the device near the fan 34 that limits the volume of air the fan 34 can push to the pair of nozzles 46. Optionally, the cap 28 has a notch 70 on an upper surface and the tab 68 on the forward section of the arm 18 fits into the notch 70 to register the orifice 30 facing forward.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

We claim:

1. An aerosol spray gun comprising a body containing a fan and an arm;

a rear segment of the arm comprises a trigger;

a forward segment of the arm comprises a tab and a front pivot positioned forward of the tab;

the arm articulates about a main pivot positioned between the rear segment of the arm and the forward segment of the arm;

an aerosol can containing a liquid to be dispensed is attached to the body below the forward segment of the arm;

the aerosol can has a cap including an integral valve;

the cap has an orifice on a forward facing side;

the orifice defines a center of a spray axis;

the fan draws in air and pushes the air through a conduit to a nozzle assembly;

the nozzle assembly slides vertically in a track at a front end of the body;

the nozzle assembly has a central aperture through which the spray axis passes;

the nozzle assembly includes a pair of nozzles, one each on opposing sides of the central aperture;

the air exits the nozzle assembly through the pair of nozzles;

the nozzle assembly is connected to the front pivot;

when the trigger is depressed the arm articulates about the main pivot causing the tab to force the cap down to open the integral valve while simultaneously moving down the front pivot to force the nozzle assembly down the same distance as the cap thereby maintaining a center of the aperture concentric with the spray axis.

2. The spray can handle in claim 1 further characterized in that a control is provided that adjustably limits the extent of downward movement of the arm.

3. The spray can handle in claim 1 further characterized in that the nozzles are adjustable from being opposed horizontally to being opposed vertically.

4. The spray can handle in claim 1 further characterized in that an adjustable louver is provided at an air intake for the fan that limits the volume of air the fan can push to the pair of nozzles.

5. The spray can handle in claim 1 further characterized in that the cap has a notch on an upper surface and the tab on the forward section of the arm fits into the notch to register the orifice facing forward.

* * * * *